US012030155B2

(12) United States Patent
Moos et al.

(10) Patent No.: US 12,030,155 B2
(45) Date of Patent: Jul. 9, 2024

(54) HONING MACHINE

(71) Applicant: KADIA Produktion GmbH + Co., Nürtingen (DE)

(72) Inventors: Uwe Moos, Dettingen an der Erms (DE); Roland Regler, Georgensgmünd (DE); Georg Heinle, Gomaringen (DE)

(73) Assignee: KADIA Produktion GmbH + Co., Nurtingen (DE)

( * ) Notice: Subject to any disclaimer, the term of this patent is extended or adjusted under 35 U.S.C. 154(b) by 544 days.

(21) Appl. No.: 17/034,477

(22) Filed: Sep. 28, 2020

(65) Prior Publication Data

US 2021/0094141 A1 Apr. 1, 2021

(30) Foreign Application Priority Data

Sep. 27, 2019 (DE) ..... 102019214867.0

(51) Int. Cl.
*B24B 33/02* (2006.01)
*B24B 33/10* (2006.01)
(Continued)

(52) U.S. Cl.
CPC ..... *B24B 33/02* (2013.01); *B24B 33/105* (2013.01); *B24B 47/02* (2013.01); *B24B 47/10* (2013.01)

(58) Field of Classification Search
CPC ..... B24B 33/08; B24B 41/04; B24B 33/02; B24B 27/0076; B24B 27/0023;
(Continued)

(56) References Cited

U.S. PATENT DOCUMENTS 7,189,143 B2 * 3/2007 Klein ..... B23Q 5/10 451/76
8,210,907 B2 7/2012 Walter et al.
(Continued)

FOREIGN PATENT DOCUMENTS

CN 106425822 A 2/2017
CN 107160223 A 9/2017
(Continued)

OTHER PUBLICATIONS

German Office Action issued in connection with corresponding German Patent Application No. 102019214867.0.
(Continued)

*Primary Examiner* — Eric J Rosen
*Assistant Examiner* — Tyler James McFarland
(74) *Attorney, Agent, or Firm* — Akerman LLP

(57) ABSTRACT

A honing machine (100) for honing a bore in a workpiece comprises a support structure (120) fixed to the machine and at least one honing unit (130) which is mounted on the support structure and which has a main support (160), which can be mounted fixedly in relation to the support structure, and a spindle unit (150), which is supported by the main support and in which a spindle shaft (152) is rotatably mounted, wherein the spindle shaft (152) is rotatable about a spindle axis (155) by means of a rotary drive and, at a tool-side end (153), has a device for the fastening of a honing tool. The honing machine furthermore has a linear guide system which is arranged between the main support (160) and the spindle unit (150) and which serves for guiding a linear stroke movement of the spindle unit (150) relative to the main support (160), a stroke drive for generating the stroke movement of the spindle unit (150), and an alignment system (200) for setting the alignment of the spindle axis (155) in relation to the support structure (120).
(Continued)

The alignment system (200) is designed for the continuously variable, reversible setting of the alignment of the spindle axis (155) in relation to the support structure (120), wherein the alignment system is designed for the independent setting of the position of the spindle axis (155) along two mutually perpendicular axes of translation and for the setting of the orientation of the spindle axis (155) in relation to two mutually perpendicular axes of rotation.

13 Claims, 7 Drawing Sheets

(51) Int. Cl.
*B24B 47/02* (2006.01)
*B24B 47/10* (2006.01)

(58) Field of Classification Search
CPC ..... B24B 1/005; B24B 47/22; B24B 27/0007; B24B 19/14; B24B 3/28; B24B 49/16; B24B 49/18; B24B 53/08; B24B 49/00; B24B 27/0046; B23Q 15/08; B26D 3/16; B26D 7/12; G05B 2219/45; G05B 2219/162; Y10T 29/5105
USPC ..... 451/124, 127, 236, 5
See application file for complete search history.

(56) References Cited

U.S. PATENT DOCUMENTS

| | | | |
|---|---|---|---|
| 8,287,214 | B2 | 10/2012 | Sadaoka et al. |
| 9,126,296 | B2 | 9/2015 | Regler et al. |
| 9,931,727 | B2 | 4/2018 | Regler |
| 2010/0210190 | A1 | 8/2010 | Walter et al. |
| 2013/0199042 | A1 | 8/2013 | Prust et al. |
| 2014/0057535 | A1 | 2/2014 | Pohlitz |
| 2015/0111479 | A1 | 4/2015 | Barensteiner et al. |
| 2016/0303702 | A1 | 10/2016 | Xavier et al. |
| 2018/0015591 | A1 | 1/2018 | Barth et al. |
| 2019/0001461 | A1 | 1/2019 | Klein et al. |
| 2019/0039202 | A1 | 2/2019 | Nagel |

FOREIGN PATENT DOCUMENTS

| | | | | | |
|---|---|---|---|---|---|
| DE | 202015009036 | U1 | | 7/2016 | |
| DE | 202017000022 | U1 | * | 3/2017 | ..... B24B 33/02 |
| DE | 102016205537 | A1 | * | 10/2017 | ..... A61L 2/025 |
| DE | 102016205537 | A1 | | 10/2017 | |
| EP | 0048031 | A2 | | 3/1982 | |
| EP | 3020506 | A1 | * | 5/2016 | ..... B23Q 1/5406 |
| EP | 3020506 | A1 | | 5/2016 | |
| GB | 1387465 | A | | 3/1975 | |
| JP | 2000326230 | A | | 11/2000 | |
| JP | 2019081229 | A | | 5/2019 | |

OTHER PUBLICATIONS

First Office Action and Search Report dated Aug. 24, 2022 in connection with corresponding Chinese Patent Application No. 2020110259840.

* cited by examiner

HONING MACHINE

FIELD OF APPLICATION AND PRIOR ART

This application claims priority to German Patent Application DE 10 2019 214 867.0 filed Sep. 27, 2019, the entirety of which is incorporated herein by reference.

The invention relates to a honing machine for honing a bore in a workpiece.

Honing is a cutting machining method using geometrically undefined cutting edges, in the case of which a honing tool performs a cutting movement composed of two components and there is constant areal contact between one or more cutting material bodies, for example honing strips, of the honing tool and the bore inner surface to be machined. The kinematics of a honing tool are characterized by a superposition of a rotational movement and a stroke movement running in an axial direction of the bore. Normally, an optional expansion movement is also provided, which leads to a variation of the effective diameter of the honing tool.

A one-off stroke movement of the honing tool within the bore, composed of an advancement into the bore and a subsequent retraction out of the bore, is referred to as "bobbing". A repeated stroke movement within the bore, that is to say an advancement into the bore, followed by a cyclic reciprocating movement within the bore, and a subsequent retraction out of the bore at the end, is referred to as "oscillating".

In the case of oscillating honing processes, an expansion movement is generally required, because the effective diameter of the honing tool is actively varied during the oscillation. Additionally, the wear of the cutting material bodies is generally compensated by means of the expansion movement.

The kinematics of the honing tool generate a surface structure with criss-crossing machining marks on the bore inner surface. Surfaces finish-machined by honing can satisfy extremely high demands with regard to dimensional and shape tolerances, and in some cases have a special surface roughness and structure, such as for example a plateau surface, which combines low wear owing to a high material percentage contact area with the capability of being able to readily receive an oil film for lubrication. Therefore, many highly loaded sliding surfaces in engines or engine components, for example cylinder barrels in engine blocks or bore inner surfaces in housings of injection pumps, are machined by honing.

A honing machine is a machine tool suitable for the honing of bores in workpieces. Said honing machine has at least one honing unit which is mounted on a support structure fixed to the machine, for example a stand, a column or a frame. A honing unit comprises a spindle unit in which a spindle shaft is rotatably mounted. The spindle shaft is rotatable about its spindle axis by means of a rotary drive and, at a tool-side end, has a device for the fastening of a honing tool. A linear guide system is arranged between the main support and the spindle unit, which linear guide system serves for guiding a linear stroke movement of the spindle unit relative to the main support. To generate the stroke movement of the spindle unit parallel to the spindle axis, a stroke drive is provided. In general, an expansion drive for expanding the honing tool is furthermore provided. The expansion drive may for example be coupled to an advancing rod which runs in the interior of the spindle shaft.

The areal contact of the cutting material bodies with the bore inner surface generates a coaxial machining action, such that the axis of the bore and the axis of the honing tool align with one another. In general, the workpiece and/or the honing tool are provided with movement degrees of freedom such that the bore and the honing tool can align with one another.

For small workpieces with very precise bores, in each case two displacement and tilting degrees of freedom are made possible for the workpiece, and the honing tool rotates about its rigid axis of rotation and is moved up and down within the bore by means of the stroke drive. Large, heavy workpieces can be accommodated rigidly, and the honing tool is provided for example with two joints, such that the position and angular attitude of the honing tool can adapt to the present bore axis.

If both a rigid honing tool (without joints) and a rigid workpiece receptacle (without displacement and tilting degrees of freedom) are used, then the position and attitude of the bore axis in the workpiece is influenced, because the honing tool and the bore inner surface seek to align with one another, and locally different cutting conditions thus prevail in the workpiece. If only some of the degrees of freedom are restricted (for example if only the tilting of the workpiece is prevented, but the displacement is permitted and the honing tool is rigid, that is to say without joints), then in this case, the angular position of the bore axis is influenced, but the position of the centre of the bore is substantially maintained.

In order to prevent the displacement or tilting degrees of freedom from overshooting a threshold value as a result of an accumulation of tolerances in the workpiece, workpiece receptacle, main machine, honing unit and honing tool, and thus the machining quality of the bore being adversely influenced, the geometry of the honing machine should be aligned very accurately. In particular, it is important for the spindle axis to be aligned as closely as possible with the axis of the bore in the workpiece in order to attain optimum machining quality on the bore inner surfaces during the honing process. During the initial assembly process, the alignment can be precisely set at the factory. In the event of damage to the machine (for example owing to a mechanical crash as a result of maloperation) or during maintenance (for example after an exchange of a spindle motor), a renewed alignment of the geometry may be necessary.

In known honing machines from the applicant, to set the alignment of the spindle axis in relation to the support structure, use is made of an alignment system with individually ground shims which are introduced between the main machine and a carriage unit which supports the spindle unit. The shim sets are ground iteratively in a set sequence on an external grinding machine in order to compensate both angular and position errors in two planes which are perpendicular to the axis of rotation of the spindle motor. This requires experienced technicians, because, in some cases, it is necessary for multiple errors to be compensated simultaneously with one set of shims. For a renewed alignment after maintenance, it may be the case that new shims, a suitable grinding machine and an experienced technician must be available in order to return the geometry of the honing machine into a good state.

Problem and Solution

It is an object of the invention to provide a honing machine of the type mentioned in the introduction which makes it possible to precisely set, in a short time, the alignment of the spindle axis in relation to the axis of the bore to be machined.

To solve this problem, the invention provides a honing machine having the features of claim 1. Advantageous refinements are specified in the dependent claims. The wording of all the claims is incorporated in the content of the description by reference.

A generic honing machine is a machine tool suitable for the honing of bores in workpieces. Said generic honing machine has at least one honing unit which is mounted on a support structure which is fixed with respect to the machine. The support structure may for example be a vertical stand (cf. for example DE 102 514 A1) or a column, on the periphery of which multiple honing units are mounted in a circumferentially offset manner (cf. for example DE 20 2011 003 069 U1). The support structure may also have a frame on which one or more honing units are mounted. In honing machines of the type considered here, a honing unit comprises a main support, which can be mounted fixedly in relation to the support structure and which can be mounted fixedly, directly or indirectly with the interposition of an adapter unit, on the support structure, and a spindle unit, which is supported by the main support and in which a spindle shaft is rotatably mounted. The spindle shaft is rotatable about its spindle axis (axis of rotation of the spindle shaft) by means of a rotary drive (also referred to as spindle motor). The spindle motor is preferably integrated into the spindle unit, that is to say arranged within a spindle housing which accommodates the spindle shaft, though may also be arranged outside the spindle housing. The spindle shaft has, at a tool-side end, a device for the fastening of a honing tool. The honing tool may be fastened directly, or indirectly by means of an articulated rod or some other interposed device, to the spindle shaft. A linear guide system is arranged between the main support and the spindle unit, which linear guide system serves for guiding a linear stroke movement of the spindle unit relative to the main support. For example, the spindle unit may be mounted on a carriage. To generate the stroke movement of the spindle unit, a stroke drive is provided. In general, an expansion drive for expanding the honing tool is furthermore provided. The expansion drive may for example be coupled to an advancing rod which runs in the interior of the spindle shaft. An expansion drive is however not required in all cases.

According to one formulation of the claimed invention, the honing machine has an alignment system for the continuously variable, reversible setting of the alignment of the spindle axis in relation to the support structure. The alignment system is designed for independent setting of the position of the spindle axis along two mutually perpendicular axes of translation and for the setting of the orientation of the spindle axis in relation to two mutually perpendicular axes of rotation. The alignment system, or components of the alignment system which are actively involved in the setting, operate in a continuously variable manner, such that it is possible to attain a high degree of precision in a short working time.

By means of the alignment system, the spatial attitude (also referred to as "pose") of the spindle axis in space, that is to say the combination of position and orientation of the spindle axis in three-dimensional space, can be reversibly set in all degrees of freedom necessary for the alignment of the spindle axis. The orientation may also be referred to as angular attitude. The stated axes of translation and axes of rotation run transversely with respect to the spindle axis, in particular perpendicular thereto or substantially perpendicular thereto, that is to say at most with a small angular deviation of less than one degree in relation to the perpendicular direction. A fine adjustment capability in a direction parallel to the spindle axis or a capability of rotation about the spindle axis is not necessary for the alignment of a spindle shaft of a honing unit on a honing machine, and therefore does not need to be provided by the alignment system.

The inventors have recognized that the conventional approaches for the alignment require the use of highly experienced technicians, and the setting of the correct alignment is possible only with considerable expenditure of time, even for experienced technicians. Normally, shim sets are used which must be ground iteratively in a set sequence on an external grinding machine in order to compensate both angular errors and position errors in two planes which are perpendicular to the axis of rotation of the spindle shaft. Here, extensive experience is necessary because, in some cases, it is necessary for multiple errors to be compensated simultaneously with one set of shims. Furthermore, the grinding of shims is not reversible. This may mean that, in the case of shims which have been ground to too great an extent, the entire set of shims must be discarded in order to start the procedure anew.

These disadvantages, inter alia, are avoided with the use of the invention. Possible alignment errors during a first setting operation can be readily corrected in a subsequent working step owing to the reversibility of the setting capabilities. Furthermore, the setting work is facilitated by the fact that setting capabilities for the position and setting capabilities for the orientation are decoupled from one another or independent of one another. It is thus possible even for less experienced operators to perform the alignment work quickly and reliably.

In one refinement, the alignment system comprises a first setting unit and a second setting unit which is separate from the first setting unit and which is arranged with a spacing to the first setting unit. The setting units are, after the preassembly process, arranged for the coarse alignment between the support structure and the main support of the honing unit. Each of the setting units comprises first setting elements for the reversible adjustment of a spacing between the support structure and the main support in a first direction and second setting elements for the generation of a continuously variable relative movement of the main support relative to the support structure in a second direction which is perpendicular to the first direction. The setting units can be actuated independently of one another, which simplifies the setting work. Continuously variable setting of the setting variables is preferably possible. If exactly two setting units are used, it is possible to achieve reliable setting of the target variables without the overall arrangement being geometrically overdeterminate, which could lead to a deformation of the devices coupled to the spindle unit.

By means of the setting of the spacing between the support structure and the main support by means of the first setting elements, it is possible to achieve different changes in attitude of the spindle axes. If the spacing is changed by an equal spacing dimension at both setting units, this gives rise to a parallel displacement of the spindle axis in the first direction. By contrast, if the spacing is changed only at one of the setting units or the spacing dimension is changed to a different extent at the two setting units, this gives rise to a tilting or rotation of the spindle axis about an axis of rotation which is perpendicular to the first direction, if it runs parallel to the second direction. The attitude of this virtual axis of rotation in relation to the two setting units may vary and is dependent on the absolute extent of the spacing changes at the two setting units and on the nature of the spacing change (spacing increase or spacing decrease).

Similar setting capabilities arise as a result of the actuation of the second setting elements, which effect a continuously variable relative movement of the main body with respect to the support structure in a second direction, which is perpendicular to the first direction, in both setting units. If a relative displacement is implemented in both setting units by the same displacement travel in said second direction, this results in a parallel displacement of the attitude of the spindle axis without a change in its inclination. By contrast, if the displacement travels differ between the first setting unit and the second setting unit, this also results in a rotation of the spindle axis about a (virtual) axis of rotation, which runs parallel to the first direction. Here, too, the absolute attitude of this virtual axis of rotation is dependent on the ratios of the displacement travels between first setting unit and second setting unit.

The first setting unit and/or the second setting unit may have an identical or substantially identical structure, or differ from one another in terms of structure. In preferred embodiments, the first setting unit and/or the second setting unit has a base element which is designed for fixed mounting on the support structure. Furthermore, a wedge element with a first wedge surface, which faces towards the base element, and with a second wedge surface, which faces towards the main support, is provided, wherein the wedge element is displaceable along a displacement direction. Also provided is an actuating device with at least one actuating element for the displacement of the wedge element in the displacement direction. Owing to the wedge shape of the wedge element, a displacement of the wedge element in the displacement direction causes a change in spacing perpendicular to the displacement direction. Accordingly, if the displacement occurs perpendicular to the first direction, the result is a change in spacing between the base element and the elements supported thereby.

Preferably, one of the wedge surfaces is a planar wedge surface oriented orthogonally with respect to the first direction. Together with a planar counterpart surface, the planar wedge surface can define a displacement plane in which relative displacements can occur within the setting units.

Preferably, a wedge angle of the wedge element is selected such that the wedge element lies in the range of self-locking. This means that a change in load on the wedge element cannot trigger any lateral displacement of the wedge element. It is thus possible to omit separate fixing elements for fixing the wedge element in the target position. Such fixing elements may however be provided. For example, the elements of the actuating device may be utilized for the fixing of the wedge element in the desired target position. The set target position of the wedge element and thus the set orientation can be maintained unchanged over the long term, even during rough honing operation, owing to the self-locking and/or owing to separate fixing elements.

Secondly, however, the wedge angle should also be great enough that a sufficient range of adjustment for the spacing is present with the available displacement travel of the wedge element. In preferred embodiments, the wedge angle of the wedge element lies in the range between 3° and 7°, in particular in the range from 5° to 6°, though wedge angles deviating from this are also possible. In the context of operator convenience, it has proven advantageous if the wedge angle of the wedge element is selected such that a displacement by a displacement travel in the displacement direction leads to a change in spacing between the support structure and the main support, which change in spacing is in an integer ratio with respect to the displacement travel, for example such that a displacement by 10 mm causes a change in spacing by 1 mm. It has been found that such ratios are particularly easy for operators to intuitively grasp, and thus a fast, precise alignment can be promoted.

If the elements which are movable relative to one another are adjusted relative to one another by relatively large adjustment travels, angular offsets may arise which lead to mechanical stresses within the components that are connected to one another. In order to avoid disadvantages that may be associated with this, it is provided in preferred embodiments that the first setting unit and/or the second setting unit has an integrated angle compensation device for automatically compensating angular offsets and stresses possibly caused as a result, which correspond to mechanical deformations. In particular, it may be the case that, in the first setting unit and/or in the second setting unit, there is provided an integrated spherical bearing or a cylindrical bearing which has complementary sliding surfaces which lie on a spherical surface or on a cylindrical surface around a (punctiform or linear) curvature centre. In this way, compensation movements are permitted in order to prevent small angular offsets and mechanical deformations, and corresponding stresses, in the components which are possibly caused as a result. Preferably, the radii of curvature of the complementary sliding surfaces are dimensioned such that the curvature centre lies substantially on the spindle axis. It can thereby be achieved that the attitude of the spindle axis is not changed by possible compensation movements. If a spherical geometry of the sliding surfaces is provided, movement degrees of freedom which are not required should be blocked. In the case of a cylindrical geometry of the sliding surfaces, the orientation of the cylinder axis should preferably be oriented parallel to the second direction, such that the compensation function remains ensured.

BRIEF DESCRIPTION OF THE DRAWINGS

Further advantages and aspects of the invention will emerge from the claims and from the following description of preferred exemplary embodiments of the invention, which are explained below on the basis of the figures.

DETAILED DESCRIPTION OF THE EXEMPLARY EMBODIMENTS

Figure 1:
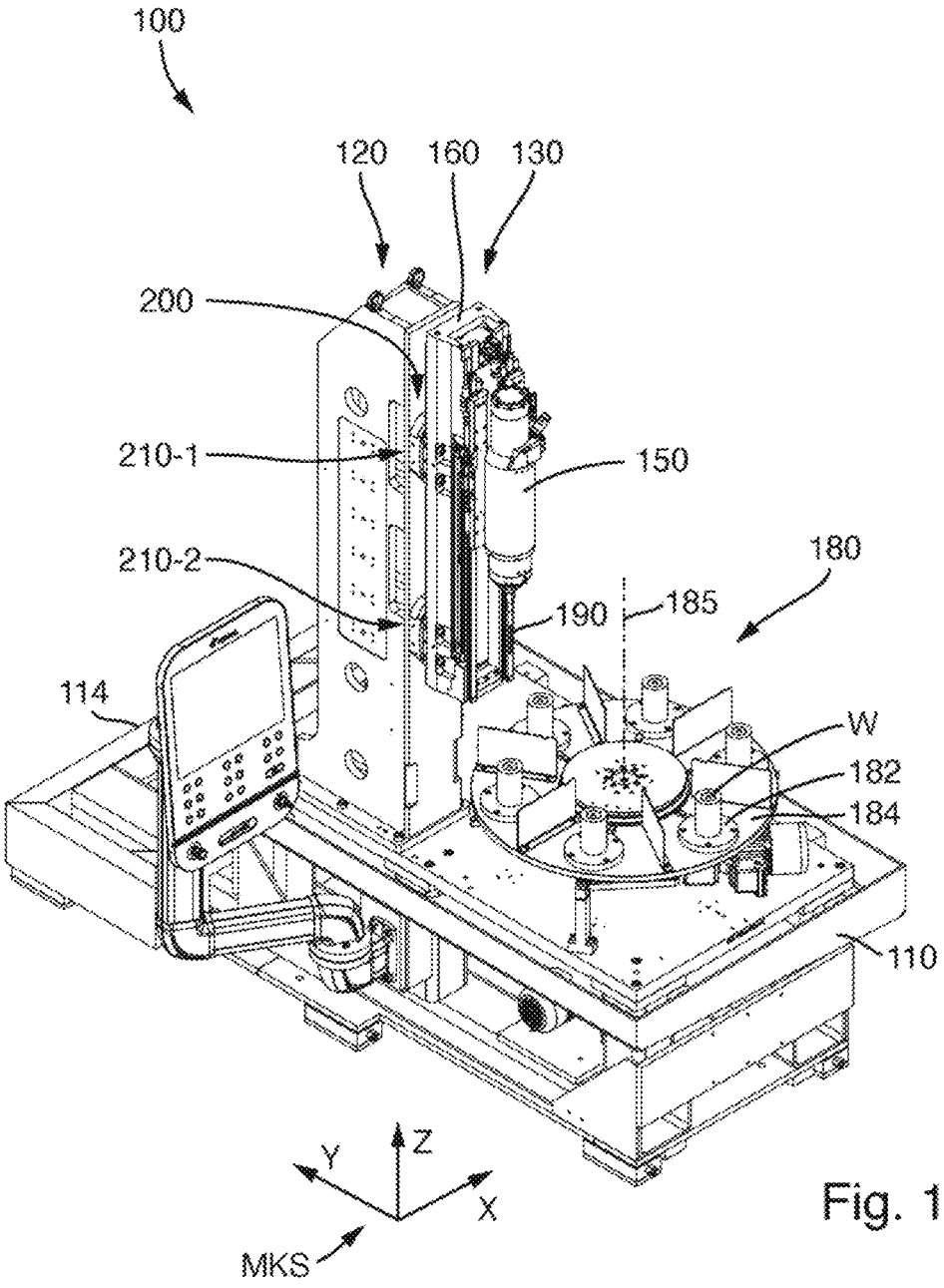
FIG. 1 shows an oblique perspective view of a honing machine according to an exemplary embodiment.
Figure 2:
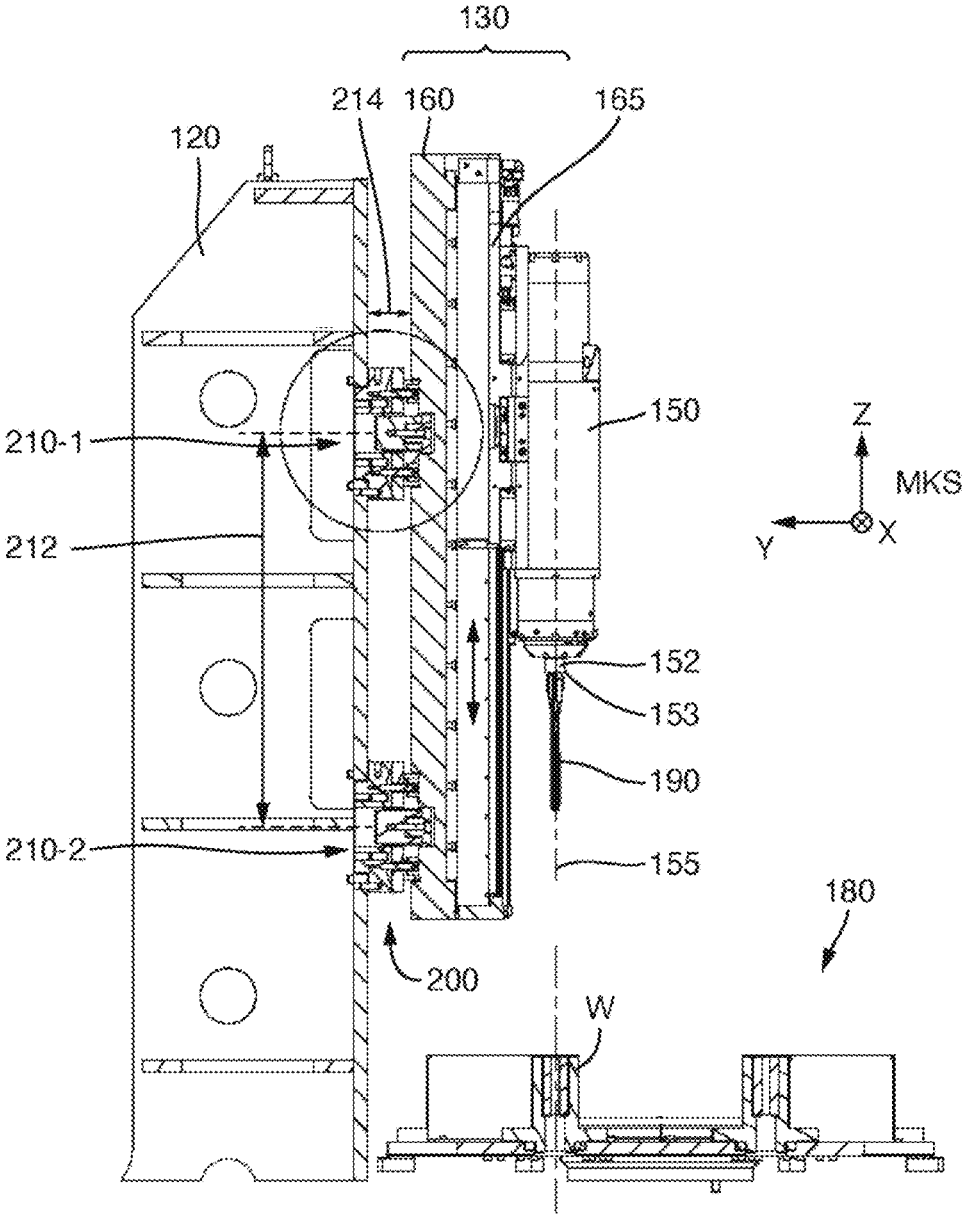
FIG. 2 shows a vertical section through a honing unit arranged on the support structure of the honing machine and components of a rotary table transport system.

FIG. 1 shows an oblique perspective view of a honing machine 100 according to an exemplary embodiment. FIG.

2 shows a vertical section through a honing unit arranged on the support structure of the honing machine and components of a rotary table transport system. In the configuration shown, the honing machine has only a single honing unit. A second support structure with a second honing unit for machining the same workpieces may be provided.

The honing machine 100 has a substantially rectangular machine base 110 with a frame and a base plate which is or should be oriented horizontally in the case of a fully set-up honing machine. The rectangular base plate is somewhat longer in the first direction (longitudinal direction) running parallel to the y axis of the machine coordinate system MKS than in the second direction (transverse direction) which is perpendicular thereto and which runs parallel to the x axis of the machine coordinate system. Close to the rear side 114 of the machine base, in the vicinity of one of the longitudinal edges, there is arranged a vertical stand 120, which is fixedly screwed to the machine base. The vertical stand serves as a support structure 120 for a honing unit 130, which is mounted on the support structure in the region of the front side of the latter.

A major constituent part of the honing unit is a spindle unit 150 in which a spindle shaft 152 is rotatably mounted. To drive the spindle shaft, there is integrated a rotary drive or spindle motor which is integrated into the spindle unit and which can drive the spindle shaft about the spindle axis 155, that is to say about the axis of rotation of the spindle shaft 152, with a predefined rotational speed profile. The spindle shaft 152 has, at a tool-side end 153, which is also referred to as spindle nose, a device (tool receptacle) for the fastening of a honing tool 190.

The spindle unit 150 is mounted on the top side or front side of a carriage plate 165. The carriage plate is supported by a carriage box 160 which serves as the main support of the honing unit. Between the main support 160, which is formed by the carriage box, and the carriage plate 165 or the spindle unit supported thereby, there is provided a linear guide system (not visible in the illustrations) for guiding a linear stroke movement of the spindle unit 150 relative to the main support 160. In the example, the stroke drive has an electric linear motor with a primary part and a secondary part which are movable relative to one another parallel to the longitudinal direction of the longitudinal guide system (ideally also parallel to the spindle axis 155).

In the example, the primary part, which is operated with an electrical current, is attached to sides of the carriage plate, or to the spindle unit 150 which is likewise operated with current, whereas a series of permanent magnets is arranged within the main support 160. A reversed arrangement is also possible.

The linear guide system has guide rails which are attached to the main support 160. The corresponding guide shoes are arranged on the bottom side of the carriage plate 165. There are also embodiments in which the guide shoes, which slide on the guide rails, are fastened to individual fastening surfaces of the spindle unit, without the interposition of a carriage plate which is common to the guide shoes.

The honing machine 100 is equipped with a workpiece transport system 180 which has a rotary table or a rotary indexing table. In the case of the illustrated rotary table transport system, a horizontally oriented table panel 184 is provided which, by means of a rotary drive arranged under the table panel, can be rotated in predefined angular steps about an axis of rotation 185 which is oriented nominally vertically (parallel to the z direction of the machine coordinate system). On a pitch circle about the axis of rotation 185, there are provided multiple (in the example, six) workpiece receptacles 182 for receiving in each case one workpiece W. During transportation, the table panel rotates through a particular angle (in this case 60°) about the axis of rotation 185, which is positioned fixedly in space, in order to successively arrange in steps in each case one workpiece W in a machining position under the honing unit 130 such that the spindle axis 155 corresponds as closely as possible to the bore axis in the workpiece W. Ideally, all workpiece receptacles are mounted so as to be as far as possible equally spaced apart from the axis of rotation 185 and as far as possible with a uniform circumferential spacing to one another. If multiple honing units or multiple honing stations are served by the rotary table transport system 180, then all honing units must be as far as possible aligned such that, in any transport position, there is as small as possible a spacing between the actual axis of rotation of the spindle motor and the bore axis in the workpiece. This means that all honing units must be correspondingly aligned in the honing machine.

The honing unit 130 is fastened by means of two fastening units 210-1, 210-2 to the front side of the stand or of the support structure 120. Here, the fastening units constitute a mechanical connection between the stand 120 (support structure 120), which is fixed with respect to the machine, and the main support 160 of the honing unit 130. The vertical spacing 212, measured in the z direction, between the effective centres of the fastening units 210-1, 210-2 amounts, in the example, to more than 30%, in particular more than 40% and/or less than 90% or less than 80% of the length, measured in the vertical direction, of the main support 160. The fastening units are not arranged at the outer ends of the main support 160 but rather are offset inward. What is particularly advantageous is an arrangement such that the fastening units are positioned such that the guide shoes, which are situated on the carriage plate which supports the spindle unit, have as small a spacing as possible to the fastening units when the spindle unit is situated in a stroke position intended for the machining process. Then, it is possible in particular for the dynamic forces that arise during an oscillating stroke movement to be particularly readily accommodated.

The fastening units 210-1 and 210-2 simultaneously function as first setting unit 210-1 and second setting unit 210-2 of an alignment system 200, the components of which are arranged at least partially between the support structure 120 and the main support 160. By means of the alignment system 200, it is possible both for the position of the spindle axis 155 to be adjusted in continuously variable and reversible fashion along two mutually perpendicular axes of translation, and for the setting of the orientation (angular attitude) of the spindle axes to be adjusted in continuously variable and reversible fashion in relation to two mutually perpendicular axes of rotation. In this way, it is possible for the spindle unit as a whole to be aligned such that its axis (spindle axis 155) is aligned as closely as possible with the axis of the bore to be machined.

Each of the setting units 210-1, 210-2 offers exactly two translational setting degrees of freedom. In the case of a first setting degree of freedom, the structural height, measured parallel to the first direction (y direction), of the setting unit can be varied in continuously variable and reversible fashion within certain limits, such that the spacing 214, measured parallel to the first direction, between the support structure 120 and the main support 160 of the honing unit at the location of the fastening unit can be varied. First setting elements are provided for this purpose. In the case of the second setting degree of freedom, it is possible for those components of the setting unit which are fixedly connected to the main support 160 of the honing unit 130 to be displaced in continuously variable and reversible fashion, parallel to the second direction (x direction), relative to those components which are fixedly connected to the support structure 120. Second setting elements are provided for this purpose. There are components which belong both to the first and to the second setting elements and which thus have a dual function (for example a wedge element discussed in more detail further below).

These two translational setting degrees of freedom, together with the fact that the two setting units 210-1, 210-2 are arranged with a vertical spacing 212 to one another (measured along the z direction or the third direction), make it possible for the position of the spindle axis 155 to be set along two mutually perpendicular axes of translation (parallel to the first direction and parallel to the second direction) and, independently of this, also for the orientation of the spindle axis 155 in relation to two mutually perpendicular axes of rotation (in each case parallel to the first direction and to the second direction) to be set in continuously variable and reversible fashion.

If, for example, both setting units 210-1, 210-2 are adjusted in terms of their effective structural height such that the spacing 214, measured parallel to the first direction, between support structure 120 and main support 160 is changed by the same magnitude, the result is a change in the position of the spindle axis 155 by parallel displacement in a y-z plane, or a translation of the spindle axis 155 in the first direction. This corresponds to purely a change in position without a change in the orientation.

If no change in spacing, or a different change in spacing than that at the second setting unit 210-2, is set at the first setting unit 210-1, this results in a change in inclination of the spindle axis 155 within the y-z plane, which leads to a rotation of the spindle axis about a virtual axis of rotation which runs parallel to the second direction (x direction) perpendicular to the y-z plane. The result is thus a change in the orientation.

If a displacement parallel to the second direction (x direction) by the same displacement travel is set at the first setting unit 210-1 and at the second setting unit 210-2, the result is a parallel displacement of the spindle axis in an x-z plane or a translation of the spindle axis 155 in the second direction. This corresponds to purely a change in position without a change in the orientation.

If displacement travels of unequal length are set at the first setting unit 210-1 and at the second setting unit 210-2, this results in an adjustment of the inclination of the spindle axis in an x-z plane, which corresponds to a rotation about a virtual axis of rotation which runs parallel to the first direction.

The spatial attitude of the virtual axes of rotation that possibly arise is not fixed but rather varies in a manner dependent on the ratios of the variations performed at the two setting units.

Figure 3:
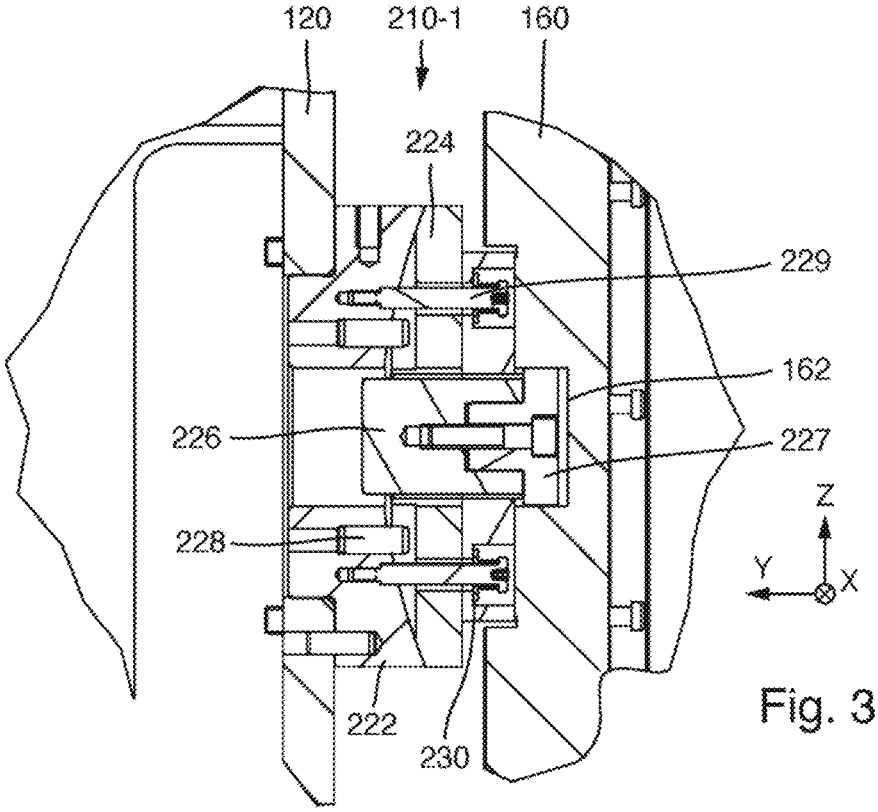
FIG. 3 shows a section along the y-z plane through a setting unit of an alignment system according to an exemplary embodiment.
Figure 4:
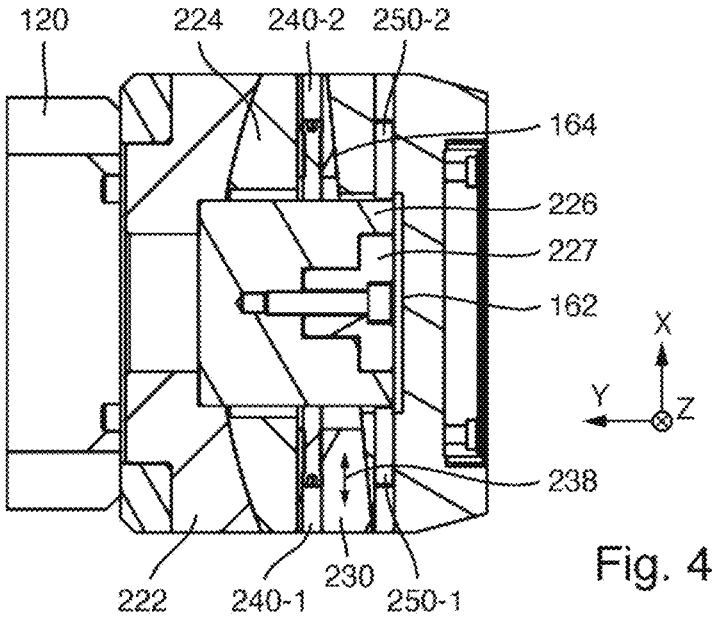
FIG. 4 shows a section parallel to the x-y plane through the setting unit from FIG. 3.
Figure 5:
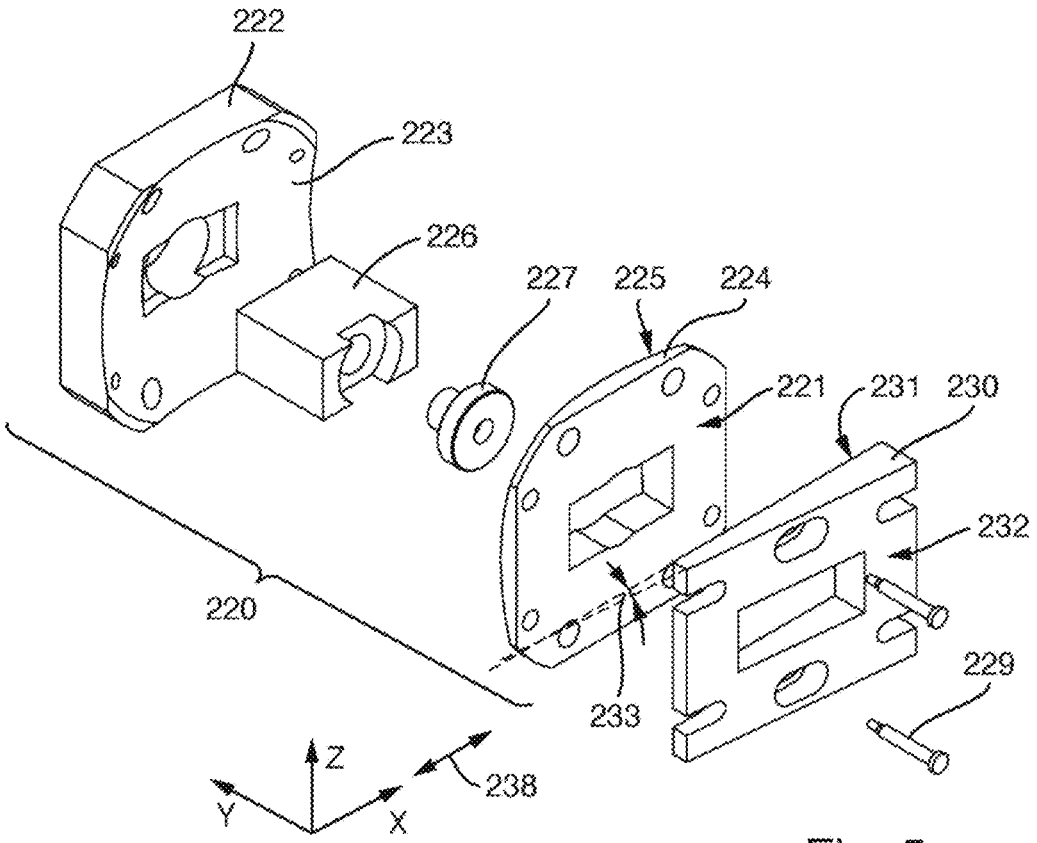
FIG. 5 shows an exploded illustration of the setting unit of FIGS. 3 and 4.

Details of the construction of the first setting unit 210-1 or of the first fastening unit 210-1 of the alignment system 200 will now be discussed in more detail below with additional reference to FIGS. 3 to 5. Here, FIG. 3 shows a section along the y-z plane through the setting unit, FIG. 4 shows a section parallel to the x-y plane, and FIG. 5 shows an exploded illustration of the first setting unit 210-1. The second setting unit 210-2 may be of identical or virtually identical construction.

The setting unit 210-1 comprises a base element 220 which is composed of multiple components and which is designed for being mounted fixedly on the support structure 120 of the honing machine or on an adapter unit which is connected fixedly to the support structure. Furthermore, a wedge element 230 is provided which has a planar first wedge surface 231 facing towards the base element 220 and has a planar second wedge surface 232 which, in the assembled state, faces towards the main support 160. The wedge surfaces 231, 232 of the relatively flat wedge enclose a wedge angle 233 of approximately 5° to 6°. In the assembled state, the planar first wedge surface 231 lies areally against a planar sliding surface 221, facing towards said first wedge surface, of the base element 220. A relative displacement of the wedge element 230 relative to said sliding surface 221 of the base element along a displacement direction 238 running parallel to the x direction (second direction) is provided by the construction, whereas relative movements in other directions are prevented by the construction. The actuating devices which are provided for activating this relative displacement and which serve for displacing the wedge element 230 in the displacement direction and for positioning the wedge element in a target position will be discussed in more detail further below.

The base element 220 includes a spherical socket 222, which serves as a basis for the fastening unit and is provided for being fixedly screwed to the support structure of the honing machine at the fastening position provided for it. In some embodiments, an adapter unit with suitable assembly interfaces is also interposed between the spherical socket and the support structure. A cylindrical pin may be used for the orientation of the spherical socket 222 in terms of attitude on the support structure 120 or on an adapter provided for connecting to the support structure. Said cylindrical pin can define the rotative position of the spherical socket in a fitting bore of the support structure or of an adapter.

On the side facing towards the wedge element, there is formed a spherically curved sliding surface 223. In the assembled state, a spherical disc 224 lies in the spherical socket 222. Said spherical disc has, on the side facing towards the spherical socket, a convex spherical sliding surface 225 corresponding with the sliding surface 223, and has, on the side facing towards the wedge element, the planar sliding surface 221. A free rotation of the spherical disc 224 in the spherical socket 222 is prevented by virtue of the spherical socket having two cylindrical pins 228 which run in a groove in the spherical disc 224. Thus, only a limited rotation about an axis of rotation running parallel to the second direction is possible.

During the assembly process, the wedge element 230 is placed onto the spherical disc 224. Said wedge element may be displaced laterally in the displacement direction (parallel to the x direction) in order to be able to set the structural height, measured parallel to the y direction, of the setting element in continuously variable and reversible fashion. Firstly, the angle of the wedge element 230 should be shallow enough that it lies in the range of self-locking. Here, this means that a change in load on the wedge element should not trigger any lateral displacement of the wedge element. Secondly, however, the angle of the wedge element should also be steep enough that a sufficient range of adjustment in the height of the wedge element is present with the available lateral displacement travel of the wedge element 230. In the exemplary embodiment, the wedge angle 223 is dimensioned such that there is an integer ratio between a lateral displacement of the wedge element and the resulting change in height of the fastening unit or of the setting unit. A wedge with a corresponding ratio of 1:10 has proven highly suitable, such that a displacement by 1 mm causes a change in height by 0.1 mm.

Two tension anchors 229 are provided for facilitating the handling of the components during the assembly process. These each exert a slight pressure on the wedge element 230 via a helical spring, such that said wedge element is supported on the spherical disc 224 and thus prevents the wedge element from lifting off the spherical disc during the assembly process.

In the fixedly installed spherical socket 222, there is fixedly installed a substantially cuboidal holding block 226. In the holding block, there is seated a bearing bolt 227 on which the main support 160 can be supported during the mounting of the honing unit 130 onto the fastening unit 210-1, in order, during the assembly process, to compensate for the mass of the honing unit with respect to the Earth's gravitational force. The bearing bolt 227 has a circular outer contour at its side facing towards the honing unit. The main support 160 has, on its side facing towards the fastening unit, a rectangular pocket or recess 162 for receiving the bearing bolt, which in the received state ideally forms linear contact (or, in the case of relatively great angles of inclination, punctiform contact) with the rectangular pocket, such that no constraint is imparted even in the event of inclination of the honing unit.

On the upper fastening unit 210-1, the bearing bolt 227 is fitted relatively tightly in said pocket on the main support 160, in order to fix the position of the honing unit in the honing machine relatively accurately already during the assembly process. On the lower fastening unit 210-2, the pocket on the main support 160 of the honing unit is somewhat larger, such that no constraint is imparted to the honing unit here either.

In the wedge element 230, on opposite sides of the polygonal cutout provided for the passage of the holding block 226, there are provided threaded bores which are oriented substantially parallel to the second direction. Into the threaded bores, there are screwed setting screws 240-1, 240-2 which serve as actuating elements of an actuating device for displacing the wedge element 230 in the displacement device 238. By means of these setting screws, the wedge element can be displaced against the holding block 226 (which is attached fixedly with respect to the machine) in the displacement direction 238. The height adjustment of the fastening element and thus the spacing adjustment (in the y direction) between support structure and main support of the honing unit at the location of the setting unit is effected by displacement of the wedge element. When the desired target position has been attained, the wedge element automatically holds this position owing to self-locking. The wedge element can however be additionally fixed in this position by tightening of the setting screws which act against one another.

On the main body 160, at the location provided for the attachment of the fastening unit or setting unit 210-1, there is formed a planar oblique surface 164 which in the assembled state interacts, as a sliding surface, with the second wedge surface 232. In the main support 160 of the honing unit, there are furthermore formed threaded bores which run parallel to the x direction and in which setting screws 250-1, 250-2 are seated. Said setting screws are likewise supported on the holding block 226 (which is installed fixedly with respect to the machine). A displacement of the main support 160 of the honing unit relative to the support structure 120, which is fixed with respect to the machine, parallel to the displacement direction 238 is possible by actuation of the setting screws 250-1, 250-2. Here, the planar second wedge surface 232 and the oppositely situated planar oblique surface 164 on the main support slide on one another. Since this is associated with a minimal change in spacing in the y direction, the setting screws 240-1, 240-2 should also be adjusted to the same extent for the purposes of compensation.

A configuration such that each rotation of the setting screw results in a fixed extent of the displacement is advantageous. For example, in the case of a thread pitch of 1 mm, one full rotation of the setting screw 250-2 results in a displacement of 1 mm. By re-measuring the positions of the parts with respect to one another, the respectively set position can be read off, and the adjustment travel that is still required can be estimated.

The basic setting of the fastening units 210-1, 210-2 is the theoretical centre, such that, in this position, in the absence of all manufacturing tolerances of the honing machine, the axis of the spindle motor, that is to say the spindle axis 155, would run exactly in alignment with the bore axis in the workpiece. Proceeding from this central position, both the height of the setting units parallel to the first direction (y direction) and also the lateral offset by relative displacement parallel to the second direction (x direction) can be reversibly set independently of one another by means of the setting screws 240-1, 240-2 and 250-1, 250-2 respectively. A lateral displacement parallel to the x direction arises here from the setting screws 250-1, 250-2 in the main support. The setting of the height of the fastening unit in the y direction arises from the setting screws or forcing-off screws 240-1, 240-2 in the wedge element 230.

In order to vary the position of the honing unit relative to the bore axis in the workpiece, the upper setting unit 210-1 and the lower setting unit 210-2 are adjusted in each case in the same direction by the same setting travel. In order to adjust the angular position of the unit, the upper setting unit and the lower setting unit are adjusted in opposite directions and/or to different extents. In the case of the fastening units being set in opposite directions and/or to different extents, an angular offset between those wedge surfaces of the wedge elements which lie on the spherical segments can occur owing to the different heights of the two setting units. This angular offset can be compensated by means of small compensation movements of the spherical discs in the spherical sockets. Thus, the spherical bearings which are integrated into the fastening units 210-1, 210-2 and which have the complementary curved sliding surfaces serve as an angle compensation device for automatically compensating angular offsets, and stresses possibly caused as a result, in the case of adverse setting conditions of the setting units. In the example, the radius of curvature of the spherical sliding surfaces 223, 225 is selected such that (in the case of the wedge element being set into its central position) the sphere central point lies on the axis of rotation of the spindle motor, that is to say on the spindle axis 155. Thus, possible compensation movements do not have an effect on the position and orientation of the spindle axis.

A method for setting the machine geometry with alignment of the spindle axis in relation to the bore axis of the bore that is to be honed may for example progress as follows.

Firstly, the fastening units 210-1, 210-2 which serve as setting units are fastened at their intended positions to the front side of the support structure by means of screws. Here, the wedge elements and the spherical discs are each brought into a central position.

The honing unit is subsequently fitted by being mounted at the top and bottom on the bearing bolts 227. The main support 160 of the honing unit 130 is then brought into a central position.

For an alignment operation, as long as possible a cylindrical geometry with reference to the workpiece receptacle or to the transport system should be provided on sides of the workpiece receptacle. For example, a master cylinder may be installed as an alignment aid at the location of a workpiece receptacle of the rotary table transport system. The cylindrical bore in the master cylinder thus represents the bore axis in the workpiece and produces the reference to the transport system. This step may be performed before or after the fitting of the honing unit on the support structure.

Thereafter, the parallelism of the axis of rotation of the spindle motor, that is to say the parallelism of the spindle axis with respect to the central longitudinal axis of the master cylinder, can be set for example by setting of the setting units in opposite directions and/or to different extents. Here, it is preferably firstly the case that the lateral setting (parallel to the displacement direction) is performed by means of the setting screws in the main support, and then the frontal setting is performed by displacement of the wedge elements.

Thereafter, the master cylinder can be dismounted, in order to measure a possible position offset of the spindle axis with respect to the setpoint position directly at those bores of the transport system in which the workpiece receptacles will later be installed.

If these measurements yield that a position offset is still required, then the position of the axis of rotation of the spindle motor with respect to the bore axis of the workpiece is set by adjustment of the setting elements in the same directions to equal extents. Here, too, it is preferably the case that firstly the lateral position (position in the x direction) is set and subsequently the frontal position (position along the first direction or y direction) is set.

When the desired target position and target orientation have been attained with sufficient accuracy, then the setting screws of the setting units are tightened without further displacement of the components thereby actuated, in order to fix the relative positions assumed.

The support structure may, as shown, be for example a vertical stand, which possibly supports only a single honing unit. A honing machine may have two or more such stands. The support structure may also be a column, on the periphery of which multiple honing units are mounted in a circumferentially offset manner (cf. DE 20 2011 003 069 U1). Instead of the direct mounting of the fastening units on the support structure, as illustrated, an indirect fastening by means of an adapter provided for connecting to the support structure is also possible.

Special features of the construction of a spindle unit 300 which is provided in some embodiments will now be described on the basis of FIGS. 6 to 8. The spindle unit 150 of the exemplary embodiments described above may be of identical construction to the spindle unit 300 described below. It is however also possible for the spindle unit 150 to have a different construction than the spindle unit 300 described here. Aside from the spindle unit, the illustrated components are denoted by the same reference designations as in the preceding examples.

The spindle unit 300 has a modular construction. The spindle unit housing 310 is constructed as a single-piece component and is also referred to here as a monocoque housing. The substantially tubular component, which is open at both sides, has a first housing portion 310-1, which accommodates the rotary drive 450, and a second housing portion 310-2, which is formed in one piece with said first housing portion and which has a smaller inner diameter than the first housing portion 310-1 and which is provided for accommodating the expansion drive 550.

The rotary drive 450 is arranged in an exchangeable first cartridge 400 and is mounted on the interior of the substantially rotationally symmetrical cartridge sleeve 410 of the first cartridge 400. The expansion drive 550 is arranged in a second cartridge 500 and is mounted within the cartridge housing 510 of the second cartridge.

The first cartridge 400 is insertable into the first housing portion 310-1 from below.

Independently of this, the second cartridge 500 with the expansion drive is insertable from above into the second housing portion 310-2. The expansion drive is coupled to an axially movable advancing rod 460 which, during the assembly of the spindle unit, is introduced into an inner passage bore of the spindle shaft 152 and, during the operation of the honing machine, acts on an axially displaceable expansion cone which is arranged in the interior of the honing tool.

Figure 6:
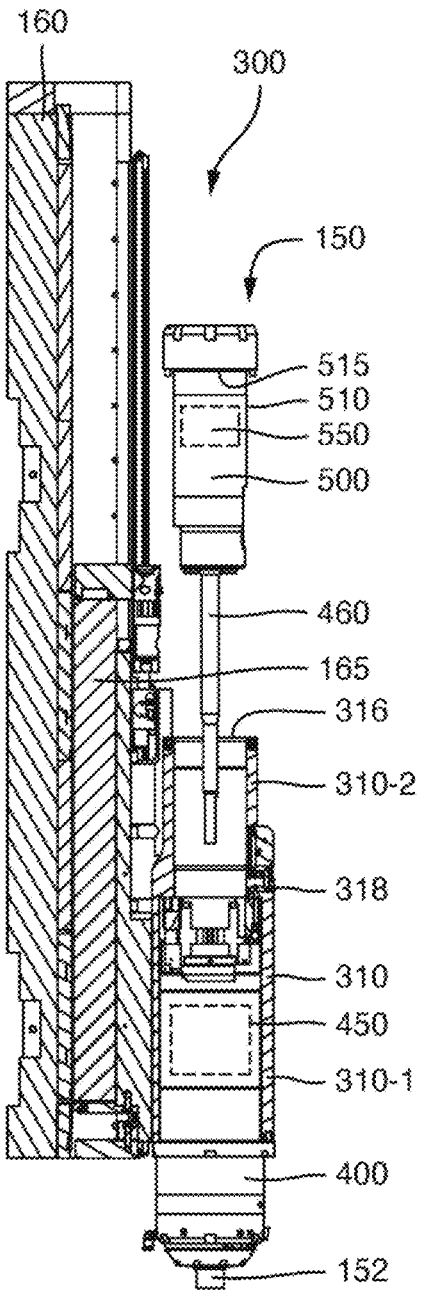
FIG. 6 shows the replacement of components of an expansion system in which the expansion drive is arranged in an exchangeable cartridge.

FIG. 6 shows a configuration in which the first cartridge 400 (with rotary drive 450) has been installed into the spindle unit housing 310 so as to be ready for operation, whereas the second cartridge 500 with the expansion drive 550 has been removed in an upward direction. FIG. 7 shows a configuration in which the second cartridge 500 with expansion drive 550 has been introduced into its associated second housing portion 310-2, whereas the first cartridge 400 with the rotary drive 450 has been removed from the spindle unit housing in a downward direction.

Figure 7:
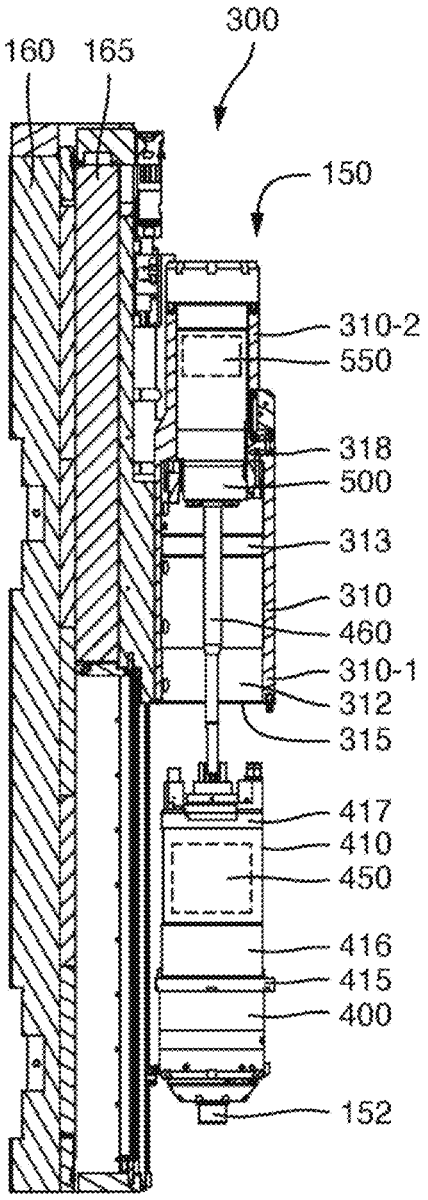
FIG. 7 shows the replacement of the spindle shaft and of other components of the spindle unit, wherein the rotary drive is arranged in an exchangeable cartridge.

The comparison of FIGS. 6 and 7 shows that the removal of the two cartridges or the installation thereof is possible at opposite sides without a large structural space requirement at the sides, because, for the removal or for the installation of the second cartridge 500, the carriage 165 which is displaceable on the main support 160 can be moved downwards, whereas, for the removal or for the installation of the first cartridge 400, the carriage 165 with the spindle unit housing 310 can move upwards, such that, in a downward direction, there remains sufficient free space for the removal of the first cartridge 400 without the risk of a collision with the transport system or with workpiece holding devices.

The single-piece spindle unit housing 310, which may be produced for example from a torsionally resistant aluminium alloy or from a fibre composite material, serves as a mechanical reference for the mutual coaxial alignment of the two cartridges 400, 500 and of the components contained therein and also as a mechanical reference for establishing the correct alignment of said components of the spindle unit 300 in relation to the linear guide system of the stroke drive.

To ensure that each of the cartridges is installed in the correct alignment and in the correct axial position in relation to the associated housing portion of the spindle unit housing, corresponding fitting surfaces are formed on the outer sides of the respective cartridges and the inner sides of the associated housing portions. In FIG. 7, the centering fitting surfaces of the first housing portion 310-1 for receiving the first cartridge 400 can be clearly seen. Directly adjoining the bottom end side 315 of the spindle unit housing 310, a rotationally symmetrical lower fitting surface 312 is formed on the inner side of said spindle unit housing. A rotationally symmetrical upper fitting surface 313 is formed with a spacing in an upward direction, that is to say in the interior of the first housing portion 310-1.

An outwardly projecting flange 415 is formed in the lower third on the cartridge housing 410 of the first cartridge 400. The upwardly pointing flange surface of said flange serves as an axial stop surface for the abutment against the end side 315 of the spindle unit housing and thus defines the axial position of the installed cartridge. Directly above the flange 415, there is situated a wide rotationally symmetrical fitting surface 416 which fits with the fitting surface 312. Above this, with a spacing, there is situated a further fitting surface 417, which fits with the upper fitting surface 313. The internally situated fit between the fitting surfaces 313 and 417 is formed with a smaller diameter than the external fit with the fitting surfaces 416 and 312 in the vicinity of the flange 415. It can thus be achieved that, during the mounting process, the respective fitting surfaces come into contact with one another only when the first cartridge 400 has been almost fully inserted into the spindle unit housing or the associated housing portion, and not already at the start of the insertion into the spindle unit housing.

A corresponding solution is also provided for the installation of the second cartridge 500 in the second housing portion 310-2. There, too, there are two fitting surface pairs, which are situated so as to be spaced apart from one another, and, on the widened head of the second cartridge 500, a stop surface 515 which, during the axial insertion of the second cartridge 500, abuts against the upper end side 316 of the spindle unit housing 310 and thus defines the axial position of the second cartridge 500 in the spindle unit housing. Thus, the correct alignment and axial position of the cartridges is set without further alignment work once the insertion of the cartridges has been completed during the mounting on the spindle unit housing.

One particular challenge consists in providing, in the spindle unit 300, suitable electrical and fluidic connections of the components installed in the first cartridge 400. Whereas the components of the second cartridge 500 which accommodates the expansion drive 550 can be contacted relatively easily directly from above by means of suitable connectors, contacting of the components (for example rotary drive) provided in the first cartridge 400 from below, that is to say from the side at which the honing tool is coupled on, is not possible or is possible only with restrictions.

In the exemplary embodiment, connection problems for the internal components of the first cartridge 400 are resolved by virtue of connecting elements of suitable plug-type connections being attached to the upper side of the first cartridge 400, that is to say to the inner side which is to face towards the second cartridge 500. Said connecting elements cooperate with corresponding connecting elements of a plug-type connection on a housing portion 318 of the spindle unit housing 310 at the stepped transition from the relatively large diameter in the first housing portion 310-1 to the relatively small diameter at the second housing portion 310-2.

Figure 8:
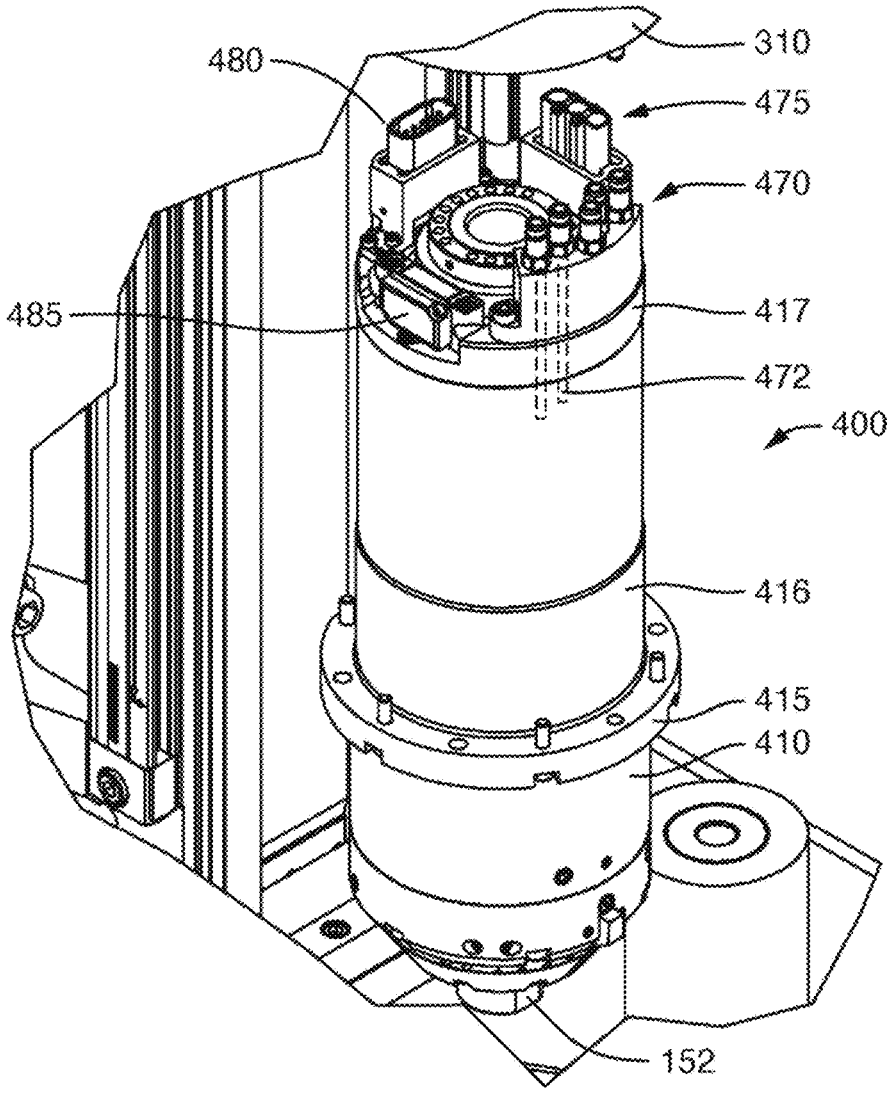
FIG. 8 shows an oblique perspective view of the cartridge containing the rotary drive, which cartridge, on its top side, has plug connectors for plug-type connections for the electrical and fluidic connection of components of the cartridge.

In the exemplary embodiment of FIG. 8, there are automatically sealing male plug connector components of fluid connecting elements 470 for the introduction or discharge of liquid or gaseous fluids. Two of the fluid plug connectors serve for the feed and discharge of cooling liquid for the cooling of the components arranged within the first cartridge 400, in particular of the rotary drive. These plug-type connectors are connected to coolant channels 472 which run in the interior of the wall of the cartridge housing 410 of the first cartridge and which are indicated here merely by dashed lines. Coolant channels may for example run in helical fashion within the cartridge housing. It is also possible to construct a channel network with partially axially running coolant channel portions and transverse connections. Two further fluid connecting elements may serve for the feed and discharge of cooling lubricant to the honing tool and from the honing tool. Gaseous fluids may also be connected. For example, a connector may be provided for conducting sealing air through the cartridge housing 410 of the first cartridge 400 to an outlet on the tool side of the first cartridge.

The electrical plug contacts 475 serve for the supply of electrical power to the rotary drive 450 and the transmission of information relating to the rotary drive, for example from temperature sensors. The electrical connections 480 serve for the transmission of signals from encoders installed in the first cartridge 400, for example of a rotary encoder of the rotary drive, for the purposes of controlling the honing machine. The rotary encoder may be composed of a static and a rotating part, wherein the static part functions as a measuring head 485.

The associated plug sockets are attached to the downwardly pointing side of the housing portion 318 at the stepped transition between the relatively large inner diameter of the first housing portion 310-1 and the relatively small inner diameter of the second housing portion 310-2. The electrical and fluid connections are automatically produced in the final phase of the insertion, when the first cartridge 400 is inserted, in the correct rotational position, into the associated first housing portion 310-1. To ensure that the first cartridge can be introduced, and inserted as far as the stop, only in a single rotational position, a corresponding structure is provided.

Figure 9A:
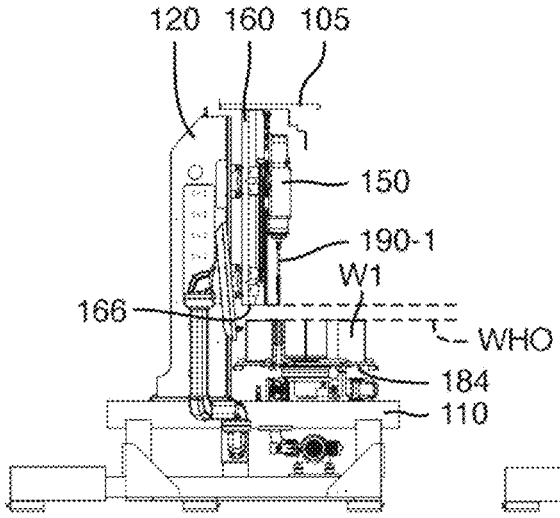
FIGS. 9A to 9D show special features of the available stroke length and stroke positions of the embodiment.

Further special features of the machine concept of the exemplary embodiment will now be discussed in conjunction with FIGS. 9A to 9D. The honing machine may be used for the honing of workpieces of very different workpiece heights and bore lengths without the need for the honing machine to be converted for this purpose. FIGS. 9A and 9B show the machining of a workpiece W1, the workpiece height of which corresponds to the maximum height WHO of a workpiece height range taken into consideration in the design. The honing machine can thus machine workpieces up to this workpiece height.

Figure 9C:
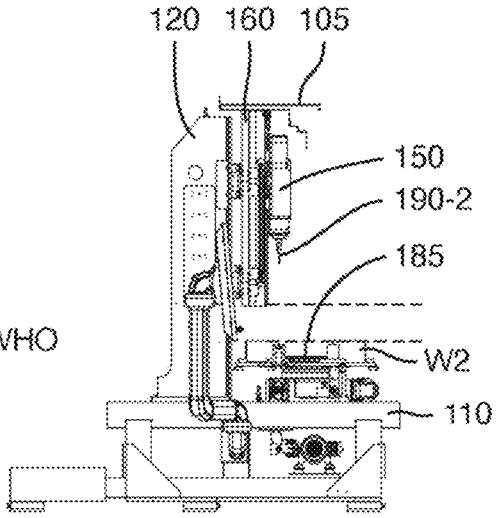
Figure 9B:
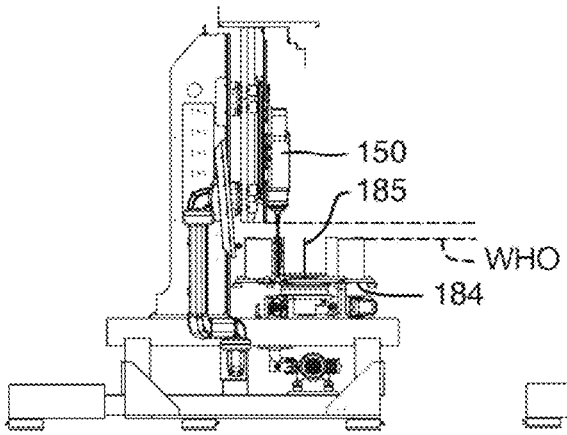
Figure 9D:
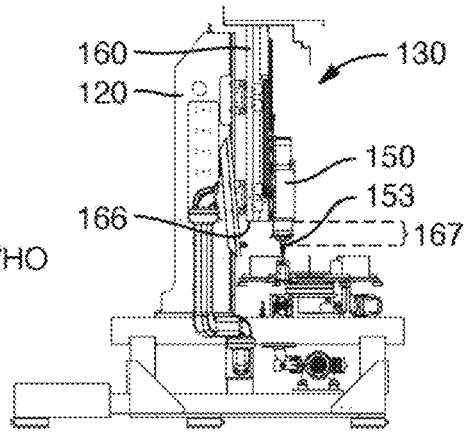

FIGS. 9C and 9D show the machining of workpieces W2 which have a smaller workpiece height and which have only a relatively short bore for machining.

A relatively long honing tool 190-1 is accordingly required for the machining of the tall workpiece W1, whereas a relatively short honing tool 190-2 can be used for the machining of the short bore in the relatively short workpiece W2, which makes it possible to realize small concentricity errors and thus high levels of machining quality.

In the design of the honing unit 130, attention is paid inter alia to an optimum axial mounting position of the main support 160 or of the carriage box 160 on the support structure 120. Here, the main support 160 is attached to the support structure 120 such that an end 166 close to the workpiece, that is to say the bottom edge 166 of the carriage box or of the main support 160, lies with a spacing above the upper boundary WHO, facing towards the spindle unit, of the workpiece height range.

It is thus possible, during rotation of the rotary table or of the table panel 184 thereof about the rotary table axis 185, for even the tallest workpieces W1 to move through below the main support 160 without collision, if the spindle unit 150 has been retracted sufficiently far upwards. In this regard, FIG. 9A shows a situation in which the spindle unit 150 has been moved into its upper end position. In the example, said spindle unit is designed such that, even in the case of the longest honing tool 190-1 being used, the tip thereof, which faces towards the workpiece, extends at most as far as the level (illustrated by means of a dashed line) of the lower edge 166 of the main support, but not further in the direction of the workpiece. In this way, firstly, free transport of the workpieces is ensured in the case of a retracted spindle unit (FIG. 9A), and secondly, the stroke length of the linear movement of the spindle unit is so great that, when the spindle unit has been moved down, the long honing tool 190-1 can machine the bore over its entire length with an oscillating stroke. In this regard, FIG. 9B shows the spindle unit at its bottom dead centre, close to the workpiece, of the oscillating stroke movement.

It is important here that the spindle unit 150 can also be moved further downwards in the direction of the workpiece if required, as will be discussed in more detail on the basis of FIG. 9D.

It can be seen from FIG. 9C that the workpiece-facing end, or the bottom edge 166, of the main support is arranged far above the movement path of the relatively short workpieces W2, such that the workpieces can be transported around the rotary table axis 185 into their respective machining position below the spindle unit without colliding with the main support.

In the case of a short honing tool 190-2 being used for machining the short bore of a short workpiece, the spindle unit 150 must be moved relatively far downwards or in the direction of the workpieces. Here, FIG. 9D shows a position of the spindle unit close to the bottom dead centre of the oscillating movement of the honing tool 190-2 in the bore of the short workpiece W2. It can be clearly seen in this illustration that, in this position, close to the workpiece, of the stroke movement of the spindle unit 150, the tool-side end 153 of the spindle shaft 152, that is to say the spindle nose 153 with the device for receiving the tool, is moved downwards beyond the lower end 166 of the main support and thus lies closer to the workpiece height range than that end 166 of the main support which is close to the workpiece. In the working position of FIG. 9D, it can also be clearly seen that the tool-side end 153 of the spindle shaft projects in a downward direction, or in the direction of the workpieces, beyond the workpiece-side end of the carriage plate 165 to the workpiece side. The projecting length 167, that is to say the length by which the spindle nose 153 projects beyond the workpiece-side end of the main support 160, may for example amount to 10% or more or 25% or more of the total length of the spindle unit between spindle nose and upper end of the expansion device.

Furthermore, owing to the use of electric direct drives for the rotary drive and the expansion drive, the spindle unit 150 is so short in an axial direction, that is to say parallel to the spindle axis, that, even in the stroke position furthest remote from the workpiece (FIG. 9A), the upper end of the spindle unit 150 does not project beyond the upper end of the main support 160. The machine roof 105 can thus be attached directly above the upper end of the main support 160, whereby an enclosure of the honing machine which is compact even in a height direction is made possible.

Tests performed by the inventors with regard to favourable dimensioning proportions have found that, for many practically relevant applications or workpieces, the workpiece height range may lie in the range from 250 mm to 500 mm, in particular in the range from 250 mm to 400 mm. The upper boundary WHO of the workpiece height range may thus lie for example 250 mm to 500 mm above a reference plane, wherein the reference plane is the plane on which the workpiece holding devices are mounted (that is to say for example the top side of the table panel). The bottom edge 166 of the main support may lie one or a few mm above this upper boundary. Expedient stroke lengths may lie for example in the range from 450 mm to 700 mm, in particular in the range from 500 mm to 650 mm. Expedient stroke positions may lie for example in the range from 150 mm to 900 mm, in particular in the range from 180 mm to 850 mm (likewise in relation to the reference plane mentioned above). Expedient lengths of the main support may lie for example in the range from 1000 mm to 1500 mm, in particular in the range from 1100 mm to 1400 mm. Expedient axial lengths of the spindle unit (measured from the spindle nose to the top side of the spindle unit housing) may lie for example in the range from 500 mm to 900 mm, in particular in the range from 600 mm to 800 mm. Typical tool lengths may lie for example in the tool length range from 100 mm to 150 mm (for the relatively short honing tools) up to 350 to 600 mm (for the relatively long honing tools).

Considering the structurally possible projecting length 167 of the spindle nose beyond the bottom edge 166 of the main support, this may lie for example in the range from 20% to 40% of the stroke length, in particular in the range from 25% to 35% of the stroke length. The upper boundary of the workpiece height range may for example amount to 50% to 75% of the stroke length, in particular 60% to 70%. The stroke length may for example lie in the range from 70% to 90% of the length of the spindle unit. Deviations from these dimensions and dimension proportions are self-evidently possible and may be expedient in particular cases.

The invention claimed is:

1. Honing machine for honing a bore in a workpiece, comprising:

a support structure fixed to the machine;

at least one honing unit mounted on the support structure and comprising:

a main support configured to be mounted fixedly in relation to the support structure, a spindle unit supported by the main support and in which a spindle shaft is rotatably mounted, wherein the spindle shaft is rotatable about a spindle axis by means of a rotary drive and, at a tool-side end, comprises a device for the fastening of a honing tool, a linear guide system arranged between the main support and the spindle unit and serving for guiding a linear stroke movement of the spindle unit relative to the main support;

a stroke drive for generating the stroke movement of the spindle unit; and an alignment system for setting the alignment of the spindle axis in relation to the support structure, wherein the alignment system is configured for a continuously variable, reversible setting of the alignment of the spindle axis in relation to the support structure, wherein the alignment system is configured for an independent setting of the position of the spindle axis along two mutually perpendicular axes of translation and for a setting of the orientation of the spindle axis in relation to two mutually perpendicular axes of rotation.

2. Honing machine for honing a bore in a workpiece, comprising:

a support structure fixed to the machine;

at least one honing unit mounted on the support structure and comprising:

a main support configured to be mounted fixedly in relation to the support structure, a spindle unit supported by the main support and in which a spindle shaft is rotatably mounted, wherein the spindle shaft is rotatable about a spindle axis by means of a rotary drive and, at a tool-side end, comprises a device for the fastening of a honing tool, a linear guide system arranged between the main support and the spindle unit and serving for guiding a linear stroke movement of the spindle unit relative to the main support;

a stroke drive for generating the stroke movement of the spindle unit; and an alignment system for setting the alignment of the spindle axis in relation to the support structure, wherein the alignment system is configured for a continuously variable, reversible setting of the alignment of the spindle axis in relation to the support structure, wherein the alignment system is configured for an independent setting of the position of the spindle axis along two mutually perpendicular axes of translation and for a setting of the orientation of the spindle axis in relation to two mutually perpendicular axes of rotation, wherein the alignment system comprises a first setting unit and a second setting unit which is separate from the first setting unit and which is arranged with a spacing to the first setting unit, wherein each of the setting units comprises first setting elements for a continuously variable adjustment of a spacing between the support structure and the main support in a first direction and second setting elements for a generation of a continuously variable relative movement of the main support relative to the support structure in a second direction perpendicular to the first direction.

3. Honing machine according to claim 2, wherein at least one of the first setting unit and the second setting unit comprises:

a base element configured for a fixed mounting on the support structure or on an adapter unit which is fixedly connectable to the support structure;

a wedge element comprising a first wedge surface facing towards the base element, and a second wedge surface facing towards the main support, wherein the wedge element is displaceable along a displacement direction;

an actuating device comprising at least one actuating element configured to generate a displacement of the wedge element in the displacement direction.

4. Honing machine according to claim 3, wherein one wedge surface of the wedge element is a planar wedge surface oriented orthogonally with respect to the first direction.

5. Honing machine according to claim 3, wherein a wedge angle of the wedge element is selected such that the wedge angle lies in the range between 3° and 7°.

6. Honing machine according to claim 2, wherein at least one of the first setting unit and the second setting unit comprises an integrated angle compensation device for automatically compensating angular offsets and stresses caused as a result.

7. Honing machine according to claim 2, wherein at least one of the first setting unit and the second setting unit comprises an integrated spherical bearing or a cylindrical bearing comprising complementary sliding surfaces which lie on a spherical surface or cylindrical surface around a curvature centre.

8. Honing machine according to claim 7, wherein the curvature centre lies on the spindle axis.

9. Honing machine according to claim 1, wherein the spindle unit comprises a spindle unit housing comprising a first housing portion for accommodating the rotary drive and a second housing portion, formed as a single piece with the first housing portion, for accommodating an expansion drive.

10. Honing machine according to claim 9, wherein the rotary drive is accommodated in an exchangeable first cartridge and the expansion drive is accommodated in an exchangeable second cartridge, wherein the first cartridge is introducible into the first housing portion and the second cartridge is introducible into the second housing portion.

11. Honing machine for honing a bore in a workpiece, comprising:

a support structure fixed to the honing machine;

at least one honing unit mounted on the support structure and comprising:

a main support configured to be mounted fixedly in relation to the support structure, a spindle unit supported by the main support and in which a spindle shaft is rotatably mounted, wherein the spindle shaft is rotatable about a spindle axis by means of a rotary drive and, at a tool-side end, comprises a device for the fastening of a honing tool, a linear guide system arranged between the main support and the spindle unit and serving for guiding a linear stroke movement of the spindle unit relative to the main support;

a stroke drive for generating the linear stroke movement of the spindle unit; and an alignment system configured for a continuously variable, reversible setting of the alignment of the spindle axis in relation to the support structure, wherein setting of the alignment comprises:

an independent setting of the position of the spindle axis along two mutually perpendicular axes of translation and of the orientation of the spindle axis in relation to two mutually perpendicular axes of rotation;

wherein the alignment system comprises at least one setting unit comprising:

a base element configured for a fixed mounting on the support structure or on an adapter unit which is fixedly connectable to the support structure;

a wedge element comprising a first wedge surface facing towards the base element, and a second wedge surface facing towards the main support, wherein the wedge element is displaceable along a displacement direction;

an actuating device comprising at least one actuating element configured to generate a displacement of the wedge element in the displacement direction; and an integrated spherical bearing comprising complementary sliding surfaces which lie on a spherical surface around a curvature centre.

12. Honing machine according to claim 11, wherein the curvature centre lies on the spindle axis.

13. Honing machine according to claim 11, wherein the spindle unit comprises a spindle unit housing comprising a first housing portion for accommodating the rotary drive and a second housing portion, formed as a single piece with the first housing portion, for accommodating an expansion drive.

* * * * *